US007527059B2

(12) United States Patent
Iannuzzi

(10) Patent No.: US 7,527,059 B2
(45) Date of Patent: May 5, 2009

(54) AROMATIC CIGARETTE SUBSTITUTE

(76) Inventor: Diane M. Iannuzzi, 13143 Avenida Del General Ave., San Diego, CA (US) 92129

( * ) Notice: Subject to any disclaimer, the term of this patent is extended or adjusted under 35 U.S.C. 154(b) by 416 days.

(21) Appl. No.: 10/926,162

(22) Filed: Aug. 24, 2004

(65) Prior Publication Data

US 2005/0016553 A1 Jan. 27, 2005

Related U.S. Application Data

(63) Continuation-in-part of application No. 10/613,888, filed on Jul. 2, 2003, now abandoned.

(60) Provisional application No. 60/393,308, filed on Jul. 2, 2002.

(51) Int. Cl.
*A24F 1/14* (2006.01)

(52) U.S. Cl. ..... 131/270

(58) Field of Classification Search ..... 131/243–247, 131/270–271

See application file for complete search history.

(56) References Cited

U.S. PATENT DOCUMENTS

| | | | | |
|---|---|---|---|---|
| 3,320,953 | A * | 5/1967 | Rindner | 128/202.21 |
| 3,683,936 | A * | 8/1972 | O'Neil, Jr. | 131/271 |
| 4,286,416 | A * | 9/1981 | Cooper, Jr. | 451/466 |
| 5,653,628 | A * | 8/1997 | Weihrauch | 451/540 |
| 5,687,746 | A * | 11/1997 | Rose et al. | 131/273 |

* cited by examiner

*Primary Examiner*—Carlos Lopez
(74) *Attorney, Agent, or Firm*—Charmasson, Buchaca & Leach, LLP

(57) ABSTRACT

A look-alike substitute for a cigarette, from which a smokeless aroma of burning tobacco or other fragrances can be inhaled and a smoke-simulating aromatized powder can be emitted out, comprises a first chamber lined with a scratch-releasable, flavor-coated insert and a second chamber filled with micrometric powder. The release of the aroma is triggered by scratching the insert with a built-in wire brush. The aromatic compound is preferably deposited on the inner surface of a replaceable hollow tube. A number of different flavored tubes are provided as part of a kit. A specially designed tip gives the appearance of glowing embers.

22 Claims, 2 Drawing Sheets

AROMATIC CIGARETTE SUBSTITUTE

PRIOR APPLICATION

This is a Continuation-In-Part of application Ser. No. 10/613,888 filed Jul. 2, 2003, now abandoned, which claims the benefit of U.S. Provisional Patent Application Ser. No. 60/393,308 filed Jul. 2, 2002.

FIELD OF THE INVENTION

This invention relates to smoking articles and more particularly to smoking device substitutes for aiding in the breaking of the smoking habit.

BACKGROUND OF THE INVENTION

Inhalation devices for simulating the look, feel and flavor of smoking articles are known in the art. U.S. Pat. No. 3,683,936 O'Neil, Jr. discloses an ingenious cigarette substitute capable of releasing flavors, fragrances, aromas, and other odors upon inhalation therethrough from substances encapsulated into microcells that can be conveniently broken by compression of the article. The aforesaid patent is specifically incorporated herein by this reference. The disclosure, however, still teaches the use of combustible material and the generation of smoke whose inhalation might be detrimental to the health of the user.

The instant invention results from an attempt to develop a look-alike and feel-alike substitute for cigarettes that does not carry any of the hazardous effects associated with the smoking of tobacco.

SUMMARY OF THE INVENTION

The principal and secondary objects of this invention are to provide a substitute for cigarettes in one or more ways.

These and other valuable objects are achieved by a cigarette substitute comprising a tubular enclosure commensurate with the size and shape of an ordinary cigarette. A first chamber in the enclosure carries a liner or insert upon which has been applied a scratch-released aromatic substance. A second chamber is filled with a powder that comes out of the article in a smoke-like cloud through agitation. The aromatic substance is released by scratching the liner using a built-in brush. The aromatic substance is preferably deposited on a replaceable plastic or paper tube. A specially designed replaceable tip gives the appearance of ash and glowing embers.

Further improvements include, depositing the aromatic substance upon the lining in the form of parallel beads or as a single helicoidal bead in order to increase the exposed surface area. Another improvement directs the flow of air being inhaled through the brush bristles to impart more flavor. Another improvement the user to emit the smoke-like cloud of powder by blowing through the article. Check-valves mounted in directionally opposite arrangement in the inlet or outlet ports of the chambers prevent the inhalation of powder. Another improvement has the powder being contained within the thread of an helicoidal spline running through the second chamber. Another improvement provides different flavored liners as part of a kit.

DESCRIPTION OF THE PREFERRED EMBODIMENT OF THE INVENTION

Figure 1:
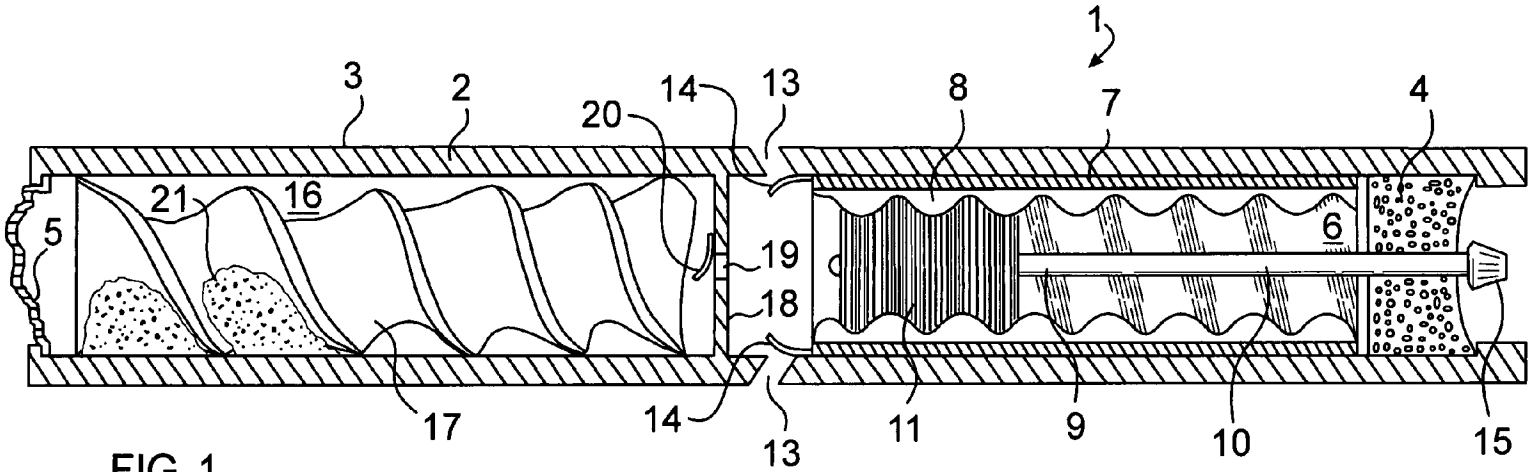
FIG. 1 is a cross-sectional view of the cigarette substitute article according to the invention.
Figure 3:
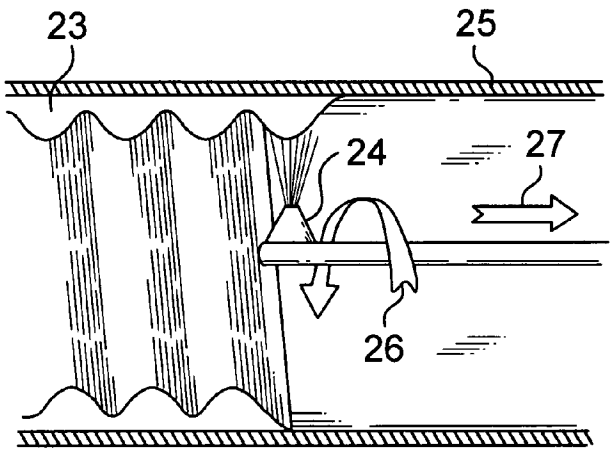
FIG. 3 is a schematical cross-sectional view of an alternate aromatic compound-depositing method.

Referring now to the drawing, there is shown in FIG. 1, a first embodiment of a cigarette substitute which allows the user to blow out a cloud of smoke-like material and inhale a tobacco aroma. The cigarette substitute 1 comprises a tubular enclosure or vessel 2 having the shape and dimension of an ordinary cigarette. The outside surface 3 of the vessel is preferably made from a durable plastic material but is colored and textured to appear like a white, paper-like material for improved realism. An air penetratable filter 4 made from paper, cotton, plastic or other inexpensive material is mounted on the proximal end of the enclosure. The purpose of this filter is dual. First, it prevents specks of saliva that might be blown by the user from entering the vessel. Secondly, it prevents loose particles of debris within the enclosure from being inhaled by the user. At the opposite distal end or terminus of the enclosure, is mounted a fine mesh grid 5 shaped unevenly to give the appearance of ash. The interior passageway of the enclosure is divided into two chambers. The first chamber 6 proximal to the filter is lined with a sheet of light-weight, non-toxic, disposable material 7 such as paper or plastic upon which has been deposited and aromatic substance 8 evocative of the smell of burning tobacco. The aromatic substance is either coated by an easily scratchable sealing or encapsulated in micro-cells of the type disclosed in the incorporated U.S. Pat. No. 3,683,936. A wire brush implement 9, not unlike a miniature bottle brush, is packaged in the center of the first chamber 6. The brush has a long, axially oriented handle 10 at the distal end of which sets of bristles 11 and are shaped and dimensioned to contact the sealing coat of the aromatic material 8. The proximate end 12 of the handle extends through the filter 4 and is thereby slidingly and rotatively mounted by the same so that the brush can be manipulated and translated axially over the entire length of the first chamber. During such manuever, the bristles 11 abrasively rub against the aromatic material 8. One or more inlet ports 13 bored through the wall of the first chamber are controlled by check-valves 14 constituted by small flaps of paper overlapping the aperture of the inlet ports. The unidirectional flow check-valves are positioned to allow only air to penetrate the chamber and to prevent exit.

Accordingly, the tobacco smoke-simulating aroma contained in the substance lining the first chamber can be conveniently released by scratching the coating layer through manipulation of the small knob 15 that protrudes on the external side of the filter 4 at the end of the handle 10. The second chamber 16 occupies the distal half of the enclosure. It contains an helicoidal spline 17 which axially spans the entire length of the chamber. The septum 18 that divides the two chambers is pierced by a small opening 19 controlled by a unidirectional flow check-valve 20 which only allows air blown through the first chamber to enter the second one. A fine powder 21 such as talc, diatomaceous earth or other micrometric powder is packed between the coils of the spline 17.

Accordingly, air blown by the user into the device will be prevented from exiting through the intake port of the first chamber, but will pass through the second chamber carrying with it a small volume of the powder 21 out of the device through the grid 5. The check valve 20 prevents any of the powder from being sucked into the first chamber.

It should be noted that the successive arrangement of the chambers is not critical. They could be coaxially disposed within the enclosure.

It should also be noted that the wire brush 9 can be provided apart from the substitute and the filter 4 eliminated. Further, the wire brush could be replaced altogether by a layer of abrasive paper as disclosed in the referenced and incorporated patent. In which case, the walls of the first chamber will be made pliable and flexible to allow the breaking up of the protective layer or capsule by abrasive contact of the materials.

Figure 2:
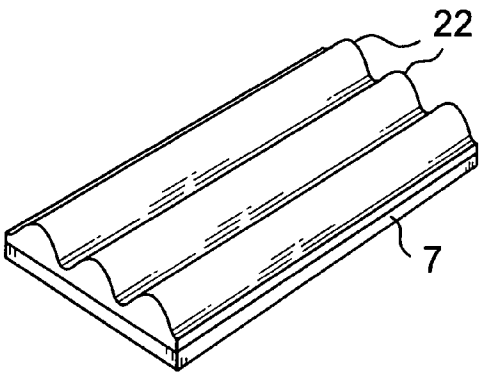
FIG. 2 is a perspective view of the aromatic compound-depositing pattern.
Figure 4:
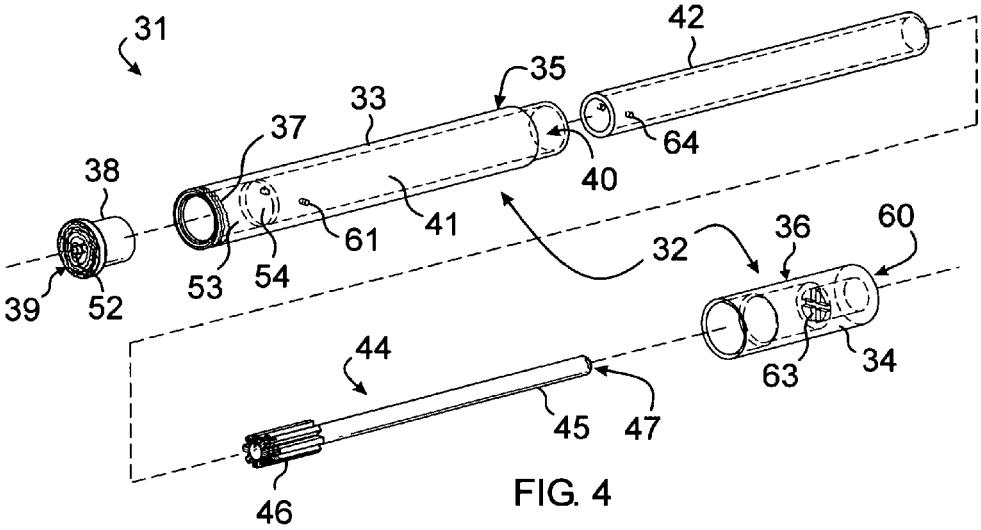
FIG. 4 is a diagrammatical exploded perspective view of an alternate embodiment of the cigarette substitute article according to the invention.
Figure 5:
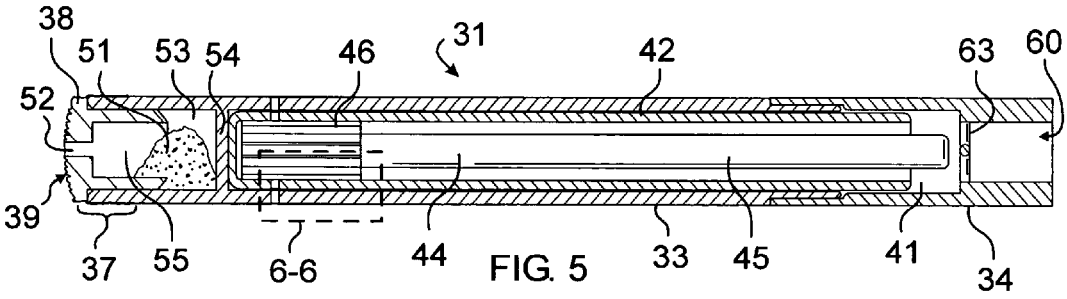
FIG. 5 is a diagrammatical top cross-sectional view of the assembled article of the embodiment of FIG. 4.
Figure 6:
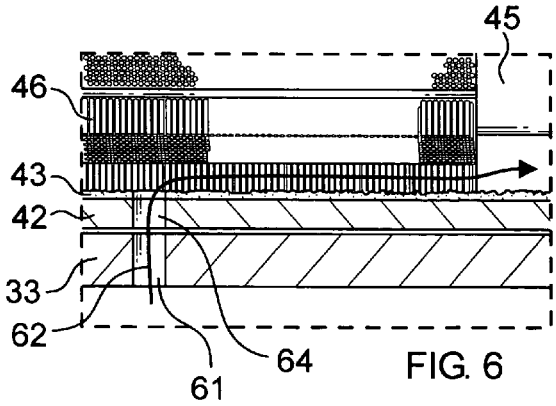
FIG. 6 is a diagrammatical enlarged cross-sectional view of the article of FIG. 4 taken on box 6-6.

In order to maximize the surface area of the aromatic substance, the material is preferably deposited in successive thinned and thickened portions in the form of parallel and adjacent beads as illustrated in FIG. 2. Alternately, a single helicoidal bead 23 can be formed by moving the nozzle 24 of an aromatic substance sprayer within a tubular paper enclosure 25 in a rotating and axially translating movement illustrated by the arrows 26 and 27.

Referring now to FIG. 4-7, there is shown a second embodiment of a cigarette substitute 31 without check-valves which allows the user to simulate smoking, and allows the user to replace an aromatic substance carrying tubular insert with a fresh or different flavored insert. The cigarette substitute 31 comprises a tubular enclosure or vessel 32 formed by a tubular "tobacco" portion 33 and a tubular "filter" portion 34 which when fitted together form the vessel and has the shape and outer dimensions of an ordinary cigarette. The outside surfaces of the vessel are treated to have an appearance which mimics a burning cigarette for improved realism. Specifically, the outer surface 35 of the "tobacco" portion 33 is treated to have the appearance of white paper for enclosing tobacco. A distal region 37 of the outer surface is further shaped and painted in shades of gray to have an ash-like appearance. The outside surface 36 of the filter portion 34 is treated to have the appearance of white or tan paper for improved realism. Such treatment can include molding of the outer surfaces to have the appearance of imperfections, and appropriate coloring to mimic the appearance of a cigarette.

The interior passageway of the enclosure is divided into two chambers 41,53. A septum 54 divides the two chambers. The first chamber 41 proximal to the user's mouth is lined with a removable liner or insert 42 in the form of either a sheet or tube of plastic, paper or other inexpensive rigid material upon which has been deposited on its inner surface, a layer of an aromatic substance 43 evocative of the smell or flavor of burning tobacco. The insert is replaced separating "tobacco" portion 33 from the "filter" portion 34 and extracting the insert through an opening 40 at the proximal end of the "tobacco" portion 33. The aromatic substance is either coated by an easily scratchable sealing layer or encapsulated in micro-cells of the type disclosed in the incorporated U.S. Pat. No. 3,683,936. A wire brush implement 44, not unlike a miniature bottle brush, is packaged coaxially in the center of the first chamber 41. The brush has a long, axially oriented handle 45 at the distal end of which sets of bristles 46 and are shaped and dimensioned to contact the layer of the aromatic material 43. The bristles are further shaped and their stiffness selected to suspend by friction the brush within the insert and thereby slidingly and rotatively mount the brush to the vessel. Upon removal of the "filter" portion 34, the proximate end 47 of the handle 45 is exposed and can be manipulated, twisted and translated axially over the entire length of the first chamber. During such a maneuver, the bristles 46 abrasively rub against the aromatic material 43 thereby activating it to emit the aroma. The aromatic material also becomes partially dislodged and coats the bristles of the brush. The user sucks on the proximal end 60 of the "filter" portion, which draws air in the inlet ports 61 formed through the sidewall of the vessel toward the distal end of the first chamber and correspondingly aligned inlet holes 64 through the sidewall of the insert 42. As indicated by the arrow 62 in FIG. 6, this air flows past the aromatic layer 43 imparting a flavor in the flow. Because the flow passes over and through the bristles 46, the surface area of the activated aromatic substance coating the bristles is greatly increased, thereby imparting flavor to a greater degree. A grate 63 blocks extraction of the brush when the "filter" portion is attached while allowing free passage of air therethrough.

At the distal end or terminus of the enclosure, is formed the second chamber 53. An ember plug 38 which is colored and has an outer surface 39 shaped unevenly to give the appearance of smoldering, glowing ash, partially closes the second chamber. An amount of fine powder 51 such as talc, diatomaceous earth or other micrometric powder is packed in the second chamber. The plug can be shaped to have an internal hollow cavity 55 which increases the volume of powder which can be stored. Accordingly, agitation such as an ash flicking motion by the user will cause a small volume of the powder 51 to flow through the outlet aperture 52 out of the device to simulate smoke.

Figure 7:
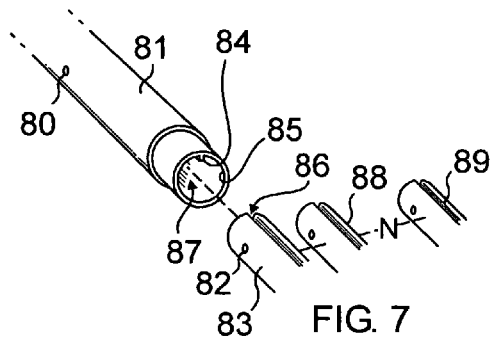
FIG. 7 is a diagrammatical exploded perspective view of an alternate embodiment of the invention in kit form having a number of different replaceable aroma liners and an alignment feature.

Referring now to FIG. 7, in order to facilitate the proper alignment of the inlet ports 80 in the sidewall of the vessel 81 with the inlet holes 82 in the insert 83, the vessel and the insert are preferably further shaped to have corresponding interlocking structures which restrict the relative roll position of the insert with respect to the vessel. The preferred means for restricting the relative roll orientation between the vessel and the insert include a pin or tongue structure 84 extending inwardly from and inner surface 85 of the vessel 81, sized and shaped to engage a corresponding groove 86 in the outer surface of the insert 83 when the insert is loaded into the vessel through its opening 87.

A number N of such inserts are provided as a kit 83,88,89 so that the user may easily replace spent inserts or select an insert having a different flavor according to mood. Different inserts in the kit would carry differently flavored aromatic substances such as "regular" or "menthol" flavored aromas.

While the preferred embodiments of the invention have been described, modifications can be made and other embodiments may be devised without departing from the spirit of the invention and the scope of the appended claims.

What is claimed is:

1. A simulated smoking device for non-burning use comprises:

a vessel defining a hollow interior;

an insert located within said interior being adapted to carry an aromatic substance thereon;

an oblong implement sized and shaped to penetrate into said interior and having a first abrasive end to scrape against said substance, thereby releasing said substance;

wherein said interior is divided by a septum into a first chamber and a second chamber; wherein said aromatic substance is located within said first chamber.

2. The device of claim 1, which further comprises a smoke-simulating powder located in said second chamber.

3. The device of claim 1, wherein said septum is penetrated by a valved opening encouraging a unidirectional flow therethrough.

4. The device of claim 3, wherein said device further comprises a spline located within said second chamber.

5. The device of claim 3, wherein said unidirectional flow goes from said first chamber to said second chamber, thereby allowing exhalation.

6. The device of claim 2, wherein a portion of said smoke-simulating powder is selected from the group consisting of talc and diatomaceous earth.

7. The device of claim 1, wherein said aromatic substance is formed to have a plurality of spaced apart thickened portions thereby increasing the surface area of said aromatic substance.

8. The device of claim 7, wherein said plurality of thickened portions are formed by a helicoidal bead.

9. The device of claim 1, wherein said implement is slidingly mounted to said device.

10. The device of claim 1, wherein said implement is rotatively mounted to said device.

11. The device of claim 1, wherein said abrasive end comprises a plurality of bristles.

12. The device of claim 1, wherein said vessel comprises a distal terminus formed into an unevenly shaped tip.

13. The device of claim 2, wherein said vessel comprises a distal terminus comprising a plug having an outlet aperture sized to allow passage of an amount of said smoke-simulating powder therethrough.

14. The device of claim 1, wherein said device further comprises said vessel having a side wall; and said side wall being formed to have at least one port therethrough in communication with said first chamber.

15. The device of claim 14, wherein said insert comprises an inlet hole located to be in substantial alignment with said port.

16. The device of claim 14, wherein said abrasive end comprises a plurality of bristles, and wherein said at least one port is located to direct a flow of inhaled air through said bristles.

17. A simulated smoking device for non-burning use comprises:

a vessel defining a hollow interior;

an amount of an aromatic substance;

an insert located within said interior carrying said amount thereon;

an oblong implement sized and shaped to penetrate into said interior and having a first abrasive end to scrape against said substance, thereby releasing said substance.

18. The device of claim 17, wherein said insert is formed into a tube removably mounted within said interior.

19. A simulated smoking device for non-burning use comprises:

a vessel defining a hollow interior;

a sheet located within said interior, said sheet carrying an amount of a releasable aromatic substance thereon; and an oblong implement sized and shaped to penetrate into said interior and having a first abrasive end to scrape against said substance, thereby releasing said substance.

20. The device of claim 19, wherein said device further comprises:

said interior being divided by a septum into a first chamber and a second chamber;

said septum being penetrated by a valved opening encouraging a unidirectional flow therethrough; and, a smoke-simulating powder located in said second chamber.

21. The device of claim 20, wherein said unidirectional flow goes from said first chamber to said second chamber, thereby allowing exhalation.

22. The device of claim 19, wherein said sheet is formed to have a plurality of spaced apart thickened portions thereby increasing the surface area of said sheet.

* * * * *